US005284031A

United States Patent [19]

Stoll et al.

[11] Patent Number: 5,284,031

[45] Date of Patent: Feb. 8, 1994

[54] KNIT PLY FABRIC WITH CONNECTING LAYER

[75] Inventors: Thomas Stoll, Reutlingen; Wolfgang Rempp, D-Sonnenbühl, both of Fed. Rep. of Germany

[73] Assignee: H. Stoll GmbH & Co., Fed. Rep. of Germany

[21] Appl. No.: 947,950

[22] Filed: Sep. 21, 1992

Related U.S. Application Data

[63] Continuation of Ser. No. 667,226, Mar. 11, 1991.

[30] Foreign Application Priority Data

Mar. 14, 1990 [DE] Fed. Rep. of Germany ..... 4008057

[51] Int. Cl.[5] ..... D04B 1/00

[52] U.S. Cl. ..... 66/64; 66/196; 66/199

[58] Field of Search ..... 66/64, 196, 197, 199

[56] References Cited

U.S. PATENT DOCUMENTS

| | | | |
|---|---|---|---|
| 395,942 | 1/1889 | Appleton | 66/198 |
| 709,827 | 9/1902 | Scott | 66/196 |
| 853,667 | 5/1907 | Williams | 66/196 |
| 864,440 | 8/1907 | Williams | 66/196 |
| 872,163 | 11/1907 | Williams | 66/196 |
| 2,002,271 | 5/1935 | Lombardi | 66/169 R |
| 2,004,699 | 6/1935 | Krautkopf | 66/64 |
| 2,140,937 | 12/1938 | Luhn | 66/169 R |
| 2,290,976 | 7/1942 | Leech et al. | 66/169 R |
| 2,821,073 | 1/1958 | Mehnert | 66/64 |
| 3,307,379 | 3/1967 | Woolley et al. | 66/196 |
| 3,422,691 | 1/1969 | Skrepek et al. | 66/169 R |
| 3,430,462 | 3/1969 | Nebel et al. | 66/169 R |
| 3,440,839 | 4/1969 | Tschumperlin | 66/62 |
| 3,451,230 | 6/1969 | Monk | 66/64 |
| 3,472,047 | 10/1969 | Gansauge | 66/62 |
| 3,501,930 | 3/1970 | Pruitt et al. | 66/169 R |
| 3,685,316 | 8/1972 | Robinson et al. | 66/177 |
| 3,733,856 | 5/1973 | Shima | 66/62 |
| 4,019,350 | 4/1977 | Schmidt | 66/196 |
| 4,100,766 | 7/1978 | Kuhnert | 66/62 |
| 4,400,952 | 8/1983 | Koike et al. | 66/116 |
| 4,563,382 | 1/1986 | Viel | 66/197 X |
| 4,586,352 | 5/1986 | Morard et al. | 66/64 R |
| 4,785,558 | 11/1988 | Shiomura | 66/196 X |
| 4,905,483 | 3/1990 | Shima | 66/64 |

FOREIGN PATENT DOCUMENTS

| | | | |
|---|---|---|---|
| 49-24187 | 6/1974 | Japan . | |
| 1562366 | 5/1990 | U.S.S.R. | 66/196 |

*Primary Examiner*—Clifford D. Crowder
*Assistant Examiner*—John J. Calvert
*Attorney, Agent, or Firm*—Larson and Taylor

[57] ABSTRACT

In the fabric structure (10.1) which can be produced in one piece on a two-bed flat-bar knitting machine, a first fabric web (11.1) and a second fabric web (12.1) are connected to one another by means of at least one third fabric web (13.1), a knitted connection being made at the coupling places (15) of the third fabric web (13.1) with the other two fabric webs (11.1, 12.1) respectively.

2 Claims, 3 Drawing Sheets

KNIT PLY FABRIC WITH CONNECTING LAYER

This application is a continuation of application Ser. No. 07/667,226 filed Mar. 11, 1991.

DESCRIPTION

The invention relates to a fabric structure consisting of a first and a second fabric web coupled to one another in places.

It is known to produce two separate fabric webs simultaneously in parallel with one another on knitting machines and also to connect them together in places, so that a two-ply fabric structure subdivided into individual pockets is obtained. Also known is a knitted constructional part, in which two knitted cloth webs are connected to one another by means of pile yarns extending between the two webs and are also maintained at a mutual distance from one another as a result of a stiffening of the pile yarns.

The object on which the invention is based is to produce fabric structures of the type mentioned in the introduction with a desired shaping in one piece on a knitting machine and in such a way that the fabric structure possesses stable knitted walls on all sides.

According to the invention, the said object is achieved in that the mutual coupling of the two fabric webs with spacing is carried out by means of at least one third fabric web which extends between the other two fabric webs and which is connected to them by knitting.

In the fabric structure designed according to the invention, the inner walls, that is to say the parts connecting the covering walls to one another, are also designed as stable fabric webs and do not consist only of individual connecting yarns. Moreover, the inner walls are not subsequently connected to the covering walls by sewing, but by knitting, this being achieved by producing the fabric structure in one piece on a knitting machine. Modern programmable flat-bar knitting machines make it possible economically to produce even spatially complicated fabric structures in one piece in this way.

In the fabric structure designed according to the invention, the third fabric web can extend, for example, in a meander-like manner between the other two fabric webs and be connected to them in a plurality of places by knitting. However, the coupling of the first and second fabric webs which determine the outer faces of the fabric structure can also be carried out by means of a plurality of additional fabric webs which are connected by knitting at a distance from one another to the two outer fabric webs. At the same time, the two outer fabric webs and also the additional inner coupling fabric webs can also each be designed, by narrowing or widening or by known gusset formations, as shaped fabric webs which give the entire fabric structure a desired specific three-dimensional shape. This can also be obtained by producing the fabric webs serving for coupling with different sectional or total lengths and/or widths. Furthermore, the individual fabric webs can be produced with different strengths and also with different yarn materials. Fabric structures designed according to the invention can be used for clothing purposes, but predominantly for technical structures in which a subsequent treatment of the fabric webs and also an at least partial filling of the interspaces formed can be carried out.

The production of the fabric structures on a two-bed flat-bar knitting machine with a transfer device can take place in various ways. Two exemplary embodiments of fabric structures with fabric webs in 1:1 or plain/face stitch are given in subclaims 7 and 8. Various exemplary embodiments of fabric structures designed according to the invention and the yarn run in the two production processes mentioned are explained in more detail below by means of the accompanying drawing.

In particular:

Figure 1:
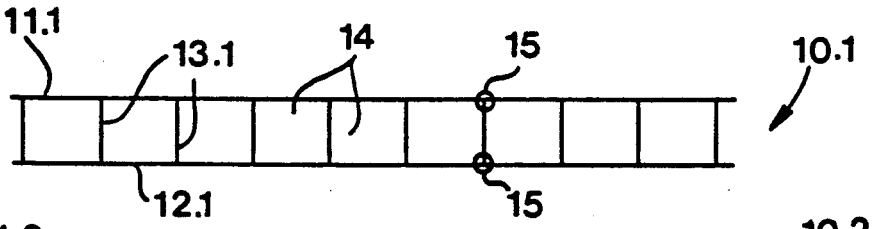
FIGS. 1 to 5 show diagrammatical cross-sections through five different exemplary embodiments of the fabric structure.

FIG. 1 shows a cross-section through a first fabric structure 10.1, the outer faces of which are formed by a first fabric web 11.1 and a second fabric web 12.1. The two fabric webs 11.1 and 12.1 are coupled to one another by means of a plurality of third or additional fabric webs 13.1, in this case arranged at a uniform distance from one another, with the result that the interspace between the two fabric webs 11.1 and 12.1 is subdivided into individual chambers 14. The additional fabric webs 13.1 are connected to the two outer fabric webs 11.1 and 12.1 at the coupling places designated by the reference 15 by knitting, that is to say by means of stitches or tuck loops, and not, for example, by being subsequently sewn together. On the contrary, the fabric structure is produced in one piece on a two-bed flat-bar knitting machine, as also explained below in conjunction with FIGS. 8 and 9.

Figure 2:
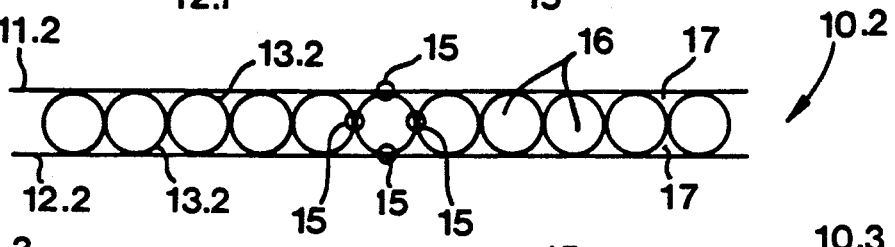

In the fabric structure 10.2 according to FIG. 2, the two outer fabric webs 11.2 and 12.2 are coupled to one another by means of tubular additional fabric webs 13.2 which are connected to the two outer fabric webs 11.2, 12.2 or to one another at the coupling places 15 by knitting. By means of the tubular additional fabric webs 13.2, the fabric structure 10.2 is subdivided into a plurality of tubular chambers 16 and triangular chambers 17.

Figure 3:
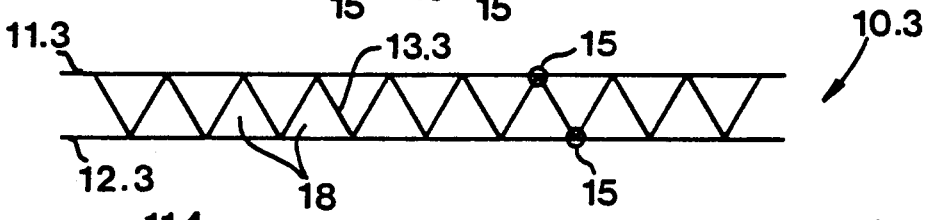

FIG. 3 shows a diagrammatical cross-section through a fabric structure 10.3, in which the two outer fabric webs 11.3 and 12.3 are connected to one another by means of a third fabric web 13.3 which extends in a meander-like manner between them and which is connected by knitting to the fabric webs 11.3 and 12.3 in a plurality of places 15. The fabric structure 10.3 is accordingly subdivided into chambers 18 of triangular cross-section.

Figure 4:
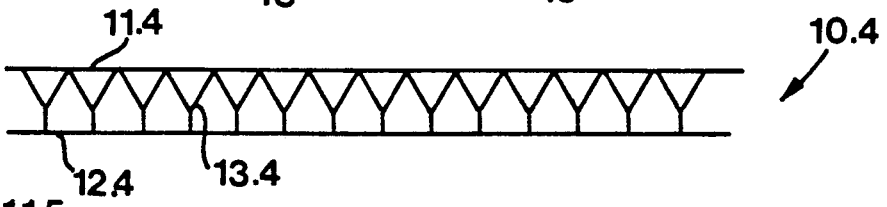
Figure 5:
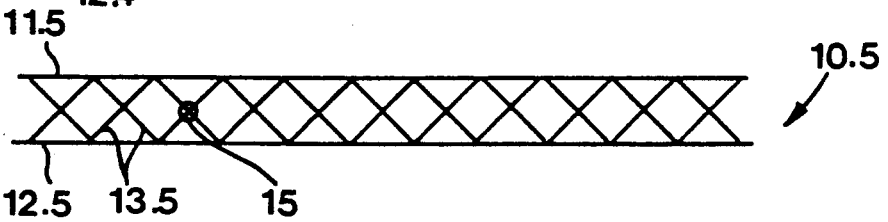

FIG. 4 shows a fabric structure 10.4, in which the coupling fabric webs 13.4 between the two outer fabric webs 11.4 and 12.4 have a Y-like cross-section. In the fabric structure 10.5 shown in FIG. 5, the coupling fabric webs 13.5 intersect one another between the two outer fabric webs 11.5 and 12.5, a knitted connection also being made at the places of intersection 15.

Figure 7:
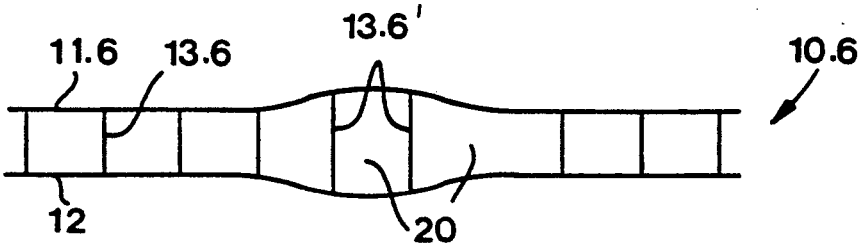
FIG. 7 shows a diagrammatical cross-section through the fabric structure according to FIG. 6 along the line VII—VII in FIG. 6.
Figure 6:
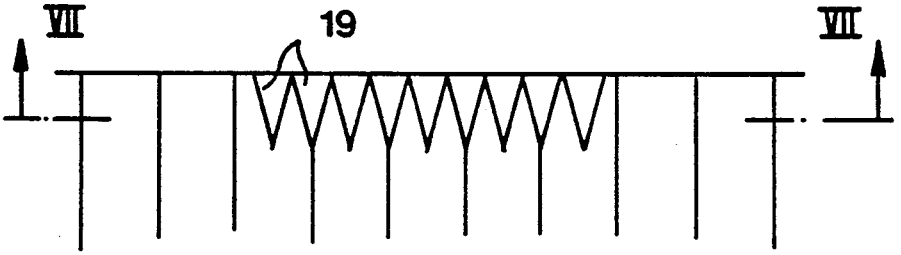
FIG. 6 shows a partial plan view of a sixth exemplary embodiment of a fabric structure.
Figure 8A:
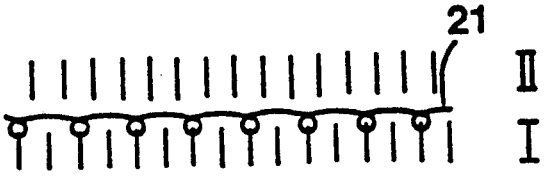
FIG. 8 shows a representation of the yarn run in a first example of a process for producing one of the fabric structures on a two-bed flat-bar knitting machine.
Figure 8B:
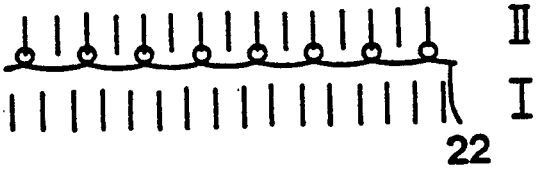
Figure 8D:
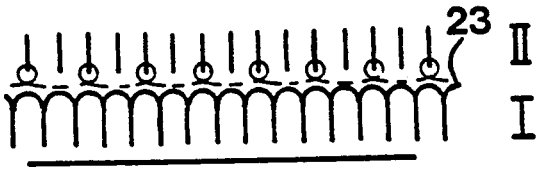
Figure 8E:
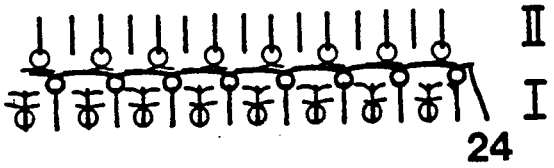
Figure 8F:
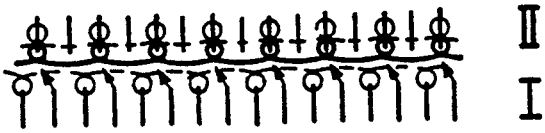
Figure 9A:
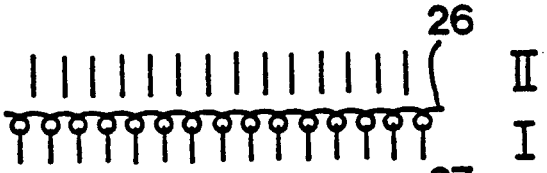
FIG. 9 shows a representation of the yarn run in a second example of the production process.
Figure 9B:
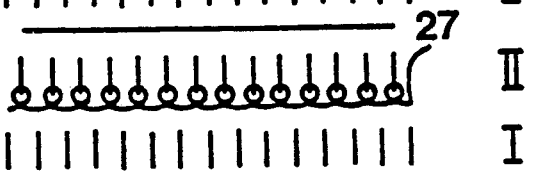
Figure 9D:
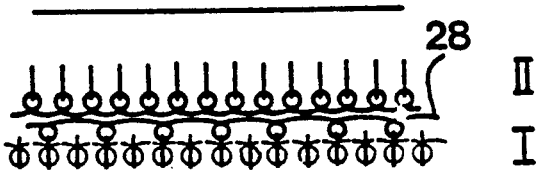
Figure 9F:
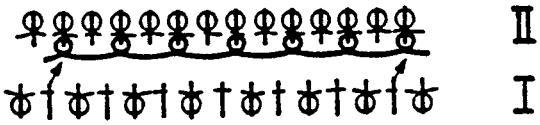
Figure 9G:
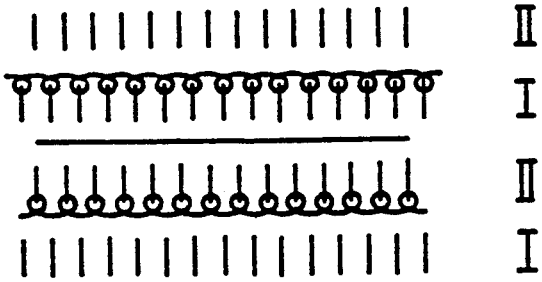
Figure 9H:
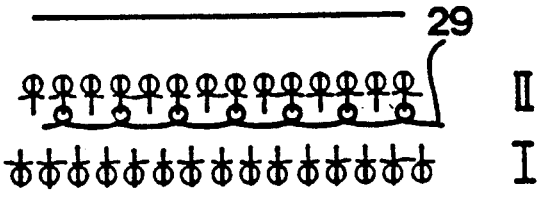
Figure 9K:
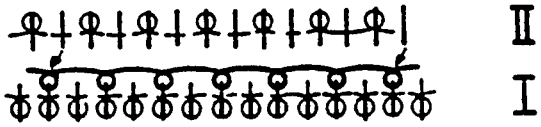

In the fabric structure 10.6 illustrated in FIGS. 6 and 7, gussets 19 are fashioned in edge regions of the two outer fabric webs 11.6 and 12.6 and lead to an outwardly directed bulging of these fabric webs and correspondingly to inner chambers 20 of differing cross-section. The inner coupling fabric webs 13.6 are made longer in the region of the bulges, as shown by the two fabric webs 13.6'.

FIG. 8 shows the yarn run in a first process for producing a fabric structure with outer fabric webs and with additional fabric webs or coupling fabric webs connecting these outer fabric webs to one another, executed on a two-bed flat-bar knitting machine with a transfer device. Each double bar row symbolises in a known way, in the lower bar row, the needles of the first or front needle bed I and, in the upper bar row, the needles of the second or rear needle bed II. Initially, in a first process step a), a course of tubular stitches 21 for the first fabric web 11 is knitted in the first needle bed I with every second needle. Subsequently, in a second process step b), a course of tubular stitches 22 for the second fabric web 12 is likewise knitted in the second needle bed II with every second needle. Process steps a) and b) are repeated until a desired length section of the first and second fabric webs 11, 12 of the fabric structure is produced. Then, in a process step d), a tucking course 23 is formed with every needle of the first needle bed I and makes the said knitted connection between a third fabric web 13 and the first fabric web 11 at a coupling place 15 of the fabric structure. Thereafter, in a process step e), a course of tubular stitches 24 for the third fabric web is formed with every second needle not used in process step a). This process step e) is repeated until the third or additional fabric web 13 has reached a desired length. Then, in a process step f), the stitches formed in the first needle bed I on every second needle are transferred onto needles of the second needle bed II and the knitted connection between the third fabric web 13 and the second fabric web 12 is thereby made. Now when knitting subsequently continues again with process steps a) and b), the next length section of the first and second fabric webs 11 and 12 is produced. The process steps described are then repeated until a desired length of fabric structure is reached.

In the production process illustrated in FIG. 9, initially, in a process step a), a course of tubular stitches 26 is knitted with every needle of the first needle bed I, and subsequently in a process step b) a course of tubular stitches 27 is knitted with every needle of the second needle bed II. The two process steps are repeated several times, the first fabric web 11 being formed from the course of tubular stitches 26 and the second fabric web 12 being formed from the course of tubular stitches 27 to a length after which a third or coupling fabric web 13 is to be attached. At this place 15, in a process step d), a course of tubular stitches 28 is knitted with every second needle of the first needle bed I and further courses of tubular stitches 28 are added until a desired length of the coupling fabric web 13 is reached. Then, in a process step f), the stitches last formed in the first needle bed I on every second needle are transferred onto needles of the second needle bed II and the knitted connection between the third fabric web 13 and the second fabric web 12 is thereby made. Subsequently, process steps a) and b) are repeated until a further length section of the first fabric web 11 and of the second fabric web 12 is produced and until the next coupling place 15, where a third fabric web 13 is once again to be attached, is reached. At this place (process step h)), a course of tubular stitches 29 is formed with every second needle of the second needle bed II and further such courses of tubular stitches 29 are added until a desired length of the third fabric web 13 is reached once again. Then, in a process step k), the stitches last formed in the second needle bed II on every second needle are transferred onto needles of the first needle bed I, in order to obtain the knitted connection between the third fabric web 13 and the first fabric web 11. Thereafter, the process steps described are repeated until the fabric structure has reached a desired total length.

The processes described in conjunction with FIGS. 8 and 9 relate to the production of a fabric structure 10.1 according to FIG. 1 with different structures of the fabric webs. In the production of other cross-sectional shapes of the fabric structures, other and also a larger number of individual process steps occur, in order to obtain the differing formation and guidance of the coupling fabric webs 13.

We claim:

1. A method of producing a fabric structure comprising first and second fabric webs coupled together in stages, using a flat-bar knitting machine comprising first and second needle beds and a transfer device, wherein the first and second fabric webs are coupled together with spacing therebetween by at least a third fabric web, by knitted stitches, and wherein said method comprises:

(a) knitting a course of stitches in the first needle bed of the knitting machine with every second needle of the first bed;

(b) knitting a course of stitches in the second needle bed of the knitting machine with every second needle of the second bed;

(c) repeating step (a) and (b) to form sections of a desired length of the first and second fabric webs;

(d) forming a tucking course with every needle of the first needle bed;

(e) forming a course of stitches with every second needle of the first needle bed not used in step (a) to thus start said third fabric web;

(f) repeating step (e) to produce a desired length of said third fabric web;

(g) transferring stitches formed in the first needle bed on every second needle onto needles of the second needle bed to thus connect said desired length of third fabric web to said second fabric web and thereby produce a three fabric web structure; and (h) repeating steps (a) to (g) until a desired overall length of said three fabric web structure is produced.

2. A method of producing a fabric structure comprising first and second fabric webs coupled together in stages, using a flat-bar knitting machine comprising first and second needle beds and a transfer device, wherein the first and second fabric webs are coupled together with spacing therebetween by at least a third fabric web, by knitted stitches, and wherein said method comprises:

(a) knitting a course of stitches with every needle of the first needle bed of the knitting machine;

(b) knitting a course of stitches with every needle of the second needle bed of the knitting machine;

(c) repeating steps (a) and (b) until sections of a desired length of the first fabric web and the second fabric web are respectively produced;

(d) knitting a course of stitches with every second needle of the first needle bed to thus start said third fabric web;

(e) repeating step (d) until a desired length of said third fabric web is produced;

(f) transferring stitches formed in the first needle bed on every second needle onto needles of the second needle bed to thus connect said third fabric web to said second fabric web;

(g) repeating steps (a) and (b) until further sections of a desired length of the first fabric web and the second fabric web are respectively produced;

(h) knitting a course of stitches with every second needle of the second needle bed to thus again start said third fabric web;

(i) repeating step (h) until a desired length of the third fabric web is produced;

(j) transferring stitches formed in the second needle bed on every second needle onto needles of the first needle bed to thus connect said third fabric web to said first fabric web to produce a three fabric web structure; and (k) repeating steps (a) to (j) until an overall desired length of said three fabric web structure is produced.

* * * * *